US007373694B1

(12) United States Patent
Kopp

(10) Patent No.: US 7,373,694 B1
(45) Date of Patent: May 20, 2008

(54) DOOR HANDGRIP NEGATING SUICIDAL ATTEMPT

(76) Inventor: Laurence D. Kopp, 74-B Cuba Hill Rd., Greenlawn, NY (US) 11740

( * ) Notice: Subject to any disclaimer, the term of this patent is extended or adjusted under 35 U.S.C. 154(b) by 235 days.

(21) Appl. No.: 11/186,084

(22) Filed: Jul. 22, 2005

(51) Int. Cl.
*E05B 1/00* (2006.01)

(52) U.S. Cl. ..... 16/412

(58) Field of Classification Search ..... 16/412, 16/415–416, 439, 444; 248/201, 200.1, 251, 248/316.1, 340; 312/348.6
See application file for complete search history.

(56) References Cited

U.S. PATENT DOCUMENTS 2,175,632 A * 10/1939 Maga ..... 16/422
3,156,944 A * 11/1964 Bohn ..... 16/412
3,847,336 A * 11/1974 Morris et al. ..... 248/291.1
3,935,787 A * 2/1976 Fisher ..... 411/16
6,113,488 A * 9/2000 Tiede ..... 454/276

FOREIGN PATENT DOCUMENTS

JP 2004162401 A * 6/2004

OTHER PUBLICATIONS

English translation of JP 2004-162401A.*

* cited by examiner

*Primary Examiner*—Chuck Y. Mah
(74) *Attorney, Agent, or Firm*—Myron Amer, P.C.

(57) ABSTRACT

A handgrip that is restricted to only being partially gripped thereabout and by reason of sloped sides causing the slippage therefrom of a closed loop, and consequently is effective in negating its use in suicidal attempts.

1 Claim, 1 Drawing Sheet

DOOR HANDGRIP NEGATING SUICIDAL ATTEMPT

BACKGROUND OF THE INVENTION

The present invention relates generally to an end use not covered by my prior patent for thwarting suicidal attempts of mentally ill persons using a closet clothes rod, namely, negating suicidal attempts using a door handgrip.

EXAMPLES OF THE PRIOR ART

The problem posed by a closet clothes rod being used for attempted, and actually achieved, suicides at hospital facilities for mentally ill patients is the focus of U.S. Pat. No. 4,643,318 for "Safety Closet Rod System" issued on Feb. 17, 1987 to this inventor, Laurence D. Kopp. The elevated and stationary condition of the clothes rod was used to support a belt in a depending relation terminating in a noose configuration. Equally foreboding is a door handgrip, but the solution of the '318 patent of causing the release of the clothes rod under the body weight of a patient is not available for a door handgrip, because the handgrip mounting on the door must be substantial enough to withstand the normal abuse of use for urging the door in opening and closing movements. In door handgrip technology there is lacking a handgrip construction which negates suicidal attempts.

SUMMARY OF THE INVENTION

Broadly it is an object of the present invention to overcome the foregoing and other shortcomings of the prior art.

More particularly, it is an object to impart a construction to the handgrip which is constrained against an attachment thereto that can be made by the free end of a noose-configurated opposite end of a belt or the like, and nevertheless not impair the door-opening functioning of the handgrip, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
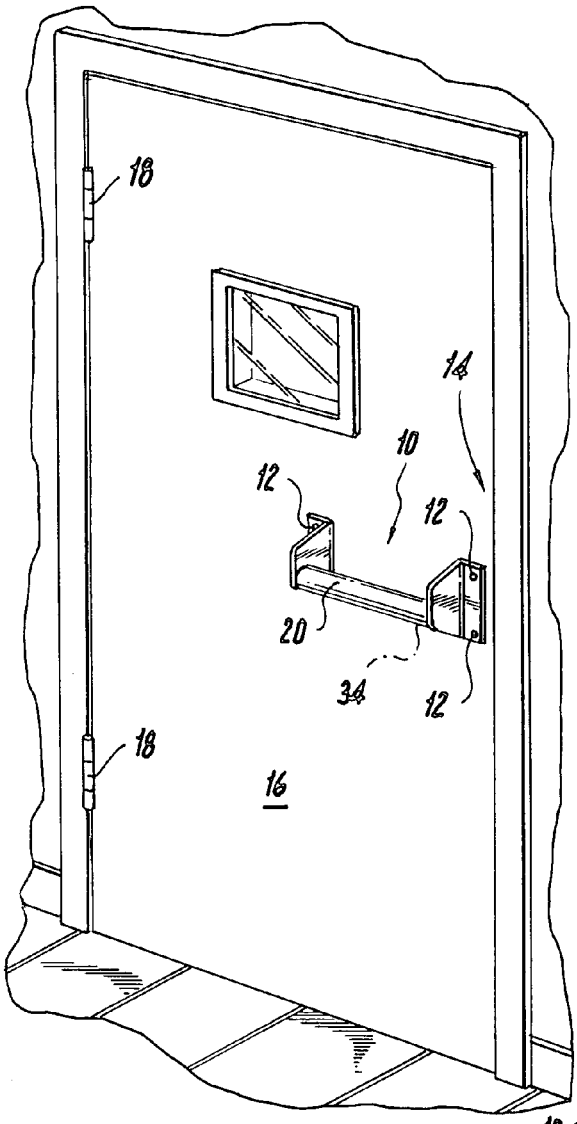
FIG. 1 is a partial perspective view of an end use of the door handgrip according to the present invention.
Figure 2:
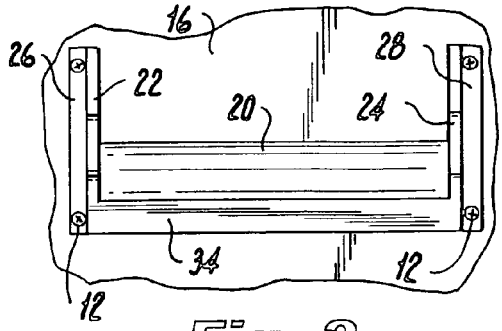
FIG. 2 is an isolated view, in front elevation, of the handgrip.

In a prior U.S. Pat. No. 4,643,318 entitled "Safety Closet Rod System" there is disclosed "a closet rod which is yieldable [from its support] under a predetermined weight," it being explained "there are several instances wherein closet rods, mounted in the conventional manner, pose a hazard to the safety and well being of the persons using such facility. For example, mentally ill persons have been known to use such rods to hang themselves in an attempt at suicide." This patent addresses the same basic problem, but posed by a handgrip on a door, said handgrip, being generally designated 10, and is attached by screws 12 adjacent a free edge 14 of a door 16 hinged, as at 18, to partake of opening and closing movements about the axis of the hinges 18, with the aid of the handgrip 10 being used by an individual (not shown) to urge the door 16 in the movements noted.

Figure 3:
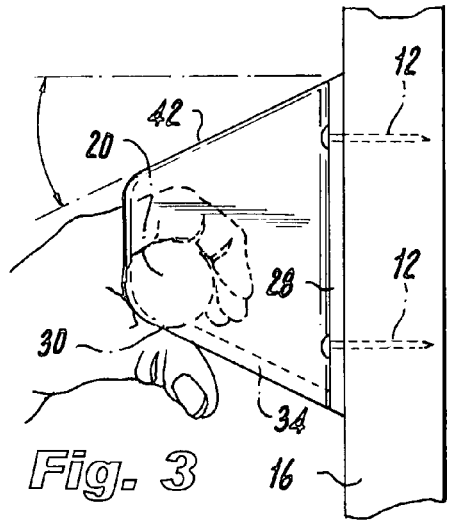
FIG. 3 is a side elevational view projected from FIG. 2.

The grip 20 per se of the handgrip 10 is appropriately attached, by welding or otherwise, to be suspended between side brackets 22 and 24, each of which brackets having flanges 26 and 28 used in the previously noted attachment to the door 16 implemented by the screws 12. The grip 20 is cylindrical in shape presenting a 360-degree peripheral surface, as best noted in FIG. 3 at 30, it being important to also note that widthwise of the grip 20 a nominal length portion 32 of the surface 30 is integral to an angularly oriented grip-blocking wall 34 extending to, and attached to the juncture of the side brackets 22, 24 and flanges 26, 28, and consequently the grip 20 cannot be entirely gripped in a 360-degree encirclement relation by an individual. This partial grip is no impediment to urging the door 16 in opening and closing movements since the partial grip is achieved by a thumb placed under the grip 20 and at least one and a half digits of four fingers placed over the grip and the pressure applied therebetween has been found in practice to accomplish the gripping function intended. The placement of the wall 34, as described which effectively prevents 360-degree encirclement of the grip 20 correspondingly effectively negates any suicidal attempt using a cord, rope or the like and the grip 20, as a stationary elevated site of attachment.

Figure 4:
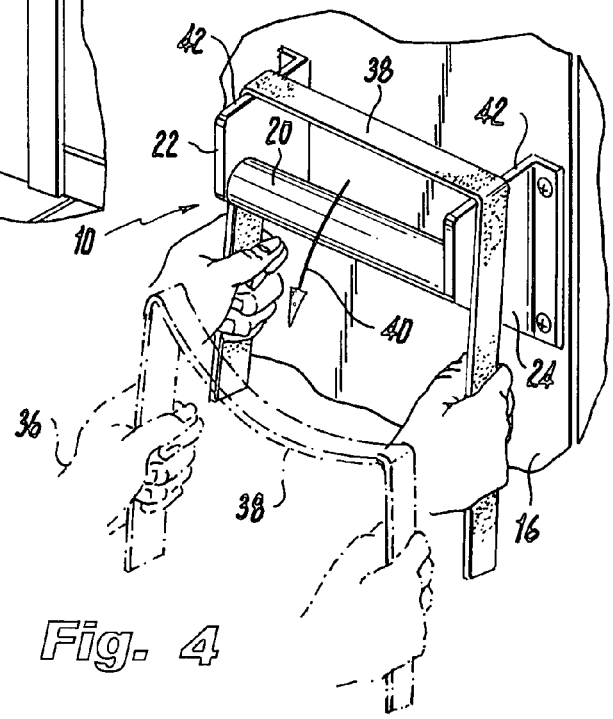
FIG. 4 is a partial perspective view illustrating in full line and phantom line perspective an operating mode of the handgrip.

Hypothesized in FIG. 4 is an individual 36 attempting a suicide using a belt 38 in a closed loop configuration in encirclement about the width expanse of the handgrip 10 which is thwarted, as noted by the arrow 40, by slippage caused by an angularly oriented slope of the top edge surfaces 42 of the side brackets 22 and 24, which in a preferred embodiment subtends an acute angle to the horizontal.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For a pivotally mounted door, a horizontal handgrip of a type presented in a clearance position spaced from said door to facilitate incident to gripping engagement therewith opening and closing of said door, an improvement negating use of said handgrip in suicidal attempts comprising:

A. grip-blocking wall means extending along a width expanse of said handgrip to a position adjacent said door, said grip-blocking wall means disposed in an angular orientation subtending an acute angle to the horizontal effective to negate a grip positioned in encircling relation entirely about said handgrip as would be permitted by an unblocked clearance between said handgrip and said door; and B. opposite spaced apart sides supporting said handgrip therebetween, each having an upper edge characterized by a downwardly oriented slope subtending an acute angle to the horizontal effective to contribute to a slipping release of any closed loop placed about said sides;

whereby an inability to support weight on said handgrip and on said handgrip sides contributes to thwarting suicidal attempts when said handgrip is attached to said door.

* * * * *